US009666384B1

(12) United States Patent
McClung et al.

(10) Patent No.: US 9,666,384 B1
(45) Date of Patent: May 30, 2017

(54) PORTABLE ACTUATOR DEVICE AND SYSTEM FOR REMOTELY OPERATING ELECTRICAL DISCONNECT SWITCHES

(71) Applicant: MarTek Limited, Charleston, WV (US)

(72) Inventors: Charles Mark McClung, Elkview, WV (US); Russell Richard Safreed, III, Saint Albans, WV (US)

(73) Assignee: MARTEK LIMITED, Charleston, WV (US)

( * ) Notice: Subject to any disclaimer, the term of this patent is extended or adjusted under 35 U.S.C. 154(b) by 0 days.

(21) Appl. No.: 15/392,294

(22) Filed: Dec. 28, 2016

Related U.S. Application Data

(60) Provisional application No. 62/291,685, filed on Feb. 5, 2016.

(51) Int. Cl.
*H01H 3/26* (2006.01)
*H01H 21/36* (2006.01)
*H01H 3/42* (2006.01)

(52) U.S. Cl.
CPC ..... *H01H 3/26* (2013.01); *H01H 3/42* (2013.01); *H01H 21/36* (2013.01); *H01H 2235/01* (2013.01)

(58) Field of Classification Search
CPC ..... G01R 11/02; H01H 11/0018; H01H 9/54; H01H 3/02; H01H 23/141; H01H 9/22
USPC .... 200/331, 334, 50.24, 400, 290, 329, 335, 200/4
See application file for complete search history.

(56) References Cited

U.S. PATENT DOCUMENTS

| | | | | |
|---|---|---|---|---|
| 4,443,676 | A * | 4/1984 | Castonguay | H02B 11/24 200/304 |
| 6,181,256 | B1 | 1/2001 | Fitzsimmons et al. | |
| 7,019,240 | B2 | 3/2006 | Eberts et al. | |
| 8,054,606 | B2 | 11/2011 | Morris et al. | |
| 8,431,845 | B2 | 4/2013 | Pollitt et al. | |
| 8,996,144 | B2 | 3/2015 | LaFrance et al. | |
| 2005/0139461 | A1* | 6/2005 | McClung | H01H 71/70 200/330 |
| 2007/0153537 | A1* | 7/2007 | Scott | B60Q 1/26 362/503 |

* cited by examiner

*Primary Examiner* — Edwin A. Leon
*Assistant Examiner* — Ahmed Saeed
(74) *Attorney, Agent, or Firm* — Thomas | Horstemeyer, LLP

(57) ABSTRACT

A portable actuator system enables the remote operation of electrical disconnect switches with a portable actuator device that is temporarily installed at the disconnect switch location. An embodiment, among others, of the portable actuator device has an electric motor having a drive shaft that can be controlled to rotate about a longitudinal axis. The actuator device also has elongated movable first and second arms that are controlled by the drive shaft. The first arm engages and moves the disconnect handle in a first rotational direction so that the disconnect handle is switched to the open position. The second arm engages and moves the disconnect handle in a second rotational direction so that the disconnect handle is switched to the closed position.

19 Claims, 14 Drawing Sheets

PORTABLE ACTUATOR DEVICE AND SYSTEM FOR REMOTELY OPERATING ELECTRICAL DISCONNECT SWITCHES

CLAIM OF PRIORITY

This application claims priority to U.S. application No. 62/291,685, filed Feb. 5, 2016, which is incorporated herein by reference in its entirety.

BACKGROUND OF THE INVENTION

Disconnect switches, such as molded-case circuit breakers, motor circuit protectors, and fused or non-fused air switches, are commonly operated by a handle located on the outside of the equipment enclosure. Typically, the disconnect handle associate with the disconnect switch is oriented to be moved in a vertical direction and will have as many as three positions, specifically, open, closed and tripped. The angular travel of the disconnect switch disconnect handle will vary among various manufacturer's designs, but typically will be between 60 and 180 degrees. The closed and open positions are located at opposing extremes of travel. If the design is such that a tripped condition can exist, then the disconnect handle of the disconnect switch will typically move to an intermediate position between the closed and open positions.

From a personnel safety perspective, it is in the best interest of the person operating this type of equipment to be positioned at a safe distance away from the equipment in case a sudden and catastrophic failure occurs when the disconnect switch is opened or closed.

SUMMARY OF THE INVENTION

The present disclosure provides embodiments of a portable actuator device and system that require no modification to existing equipment and is suitable for remotely operating disconnect switches. The portable actuator device does not require pre-positioning of its actuating arms to match the current position of the disconnect handle. The portable actuator device is capable of quickly performing all actions that a human operator might wish to accomplish, such as closing the disconnect switch, opening the disconnect switch, or resetting the disconnect switch from a tripped position.

An embodiment, among others, of a portable actuator device can be summarized as follows. The portable actuator device has an electric motor having a drive shaft that can be controlled to rotate about a longitudinal axis. The actuator device also has elongated movable first and second arms. The first arm has a distal end and a proximal end. The first arm is capable of pivoting at the proximal end about the axis when the drive shaft is rotated in a first rotational direction so that the distal end is moved about the axis in the first rotational direction. The first arm engages and moves the disconnect handle in the first rotational direction so that the disconnect handle is switched to the open position. The second arm also has a distal end and a proximal end. The second arm is capable of pivoting at the proximal end about the axis when the drive shaft is rotated in a second rotational direction so that the distal end is moved about the axis in the second rotational direction. The second rotational direction is opposite to the first rotational direction. The second arm engages and moves the disconnect handle in the second rotational direction so that the disconnect handle is switched to the closed position.

An embodiment, among others, of a portable actuator system can be summarized as follows. The portable actuator system has the portable actuator device described in the previous paragraph as well as a controller and operator interface. The controller is communicatively coupled to the electric motor to control the electric motor and the arms. The operator interface is communicatively coupled to the controller. The operator interface is designed to enable an operator to remotely control the electric motor and the arms in order to selectively engage and move the disconnect handle to the open and closed positions.

Other embodiments, devices, systems, features, characteristics, and methods of the present invention will become more apparent in the "Detailed Description of Embodiments" and accompanying drawings and claims, all of which form a part of this specification.

BRIEF DESCRIPTION OF THE DRAWINGS

The various embodiments and features of the invention will be clearly depicted in the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF EMBODIMENTS

Figure 1A:
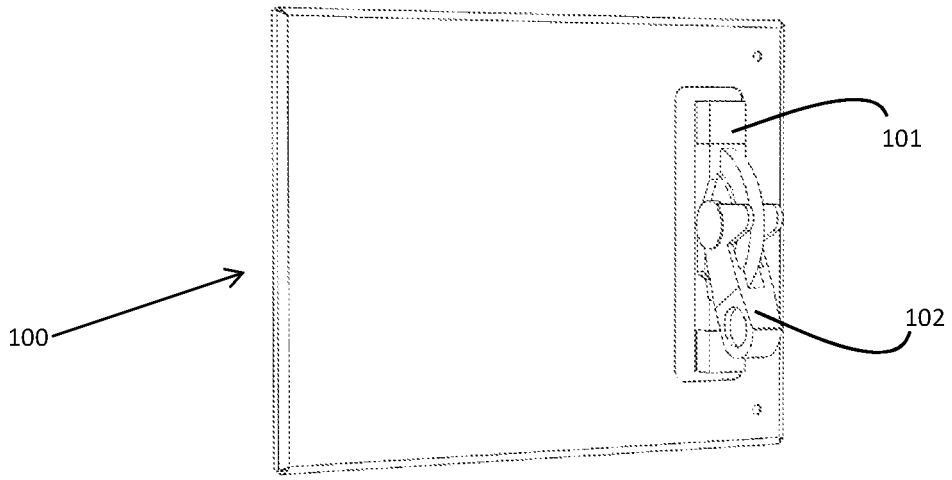
Fig. 1A (PRIOR ART)
FIG. 1A is a perspective view of a typical motor control center (MCC) disconnect switch of the prior art with a disconnect handle in an off position.
Figure 1B:
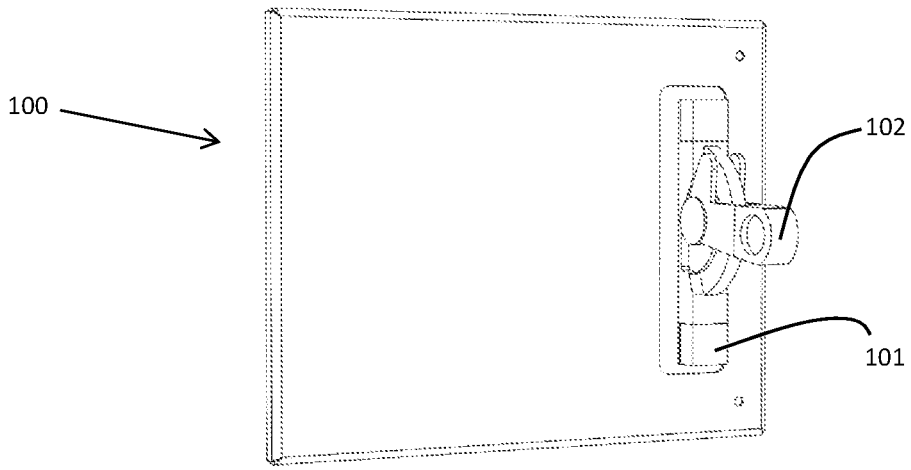
Fig. 1B (PRIOR ART)
FIG. 1B is a perspective view of the disconnect handle of FIG. 1A in an on position.

With reference to FIGS. 1A and 1B, a typical motor control center (MCC) disconnect switch 100 is depicted. FIG. 1A shows the disconnect handle 102 in the open, or off, position, with FIG. 1B showing the disconnect handle 102 in the closed, or on position.

Figure 2A:
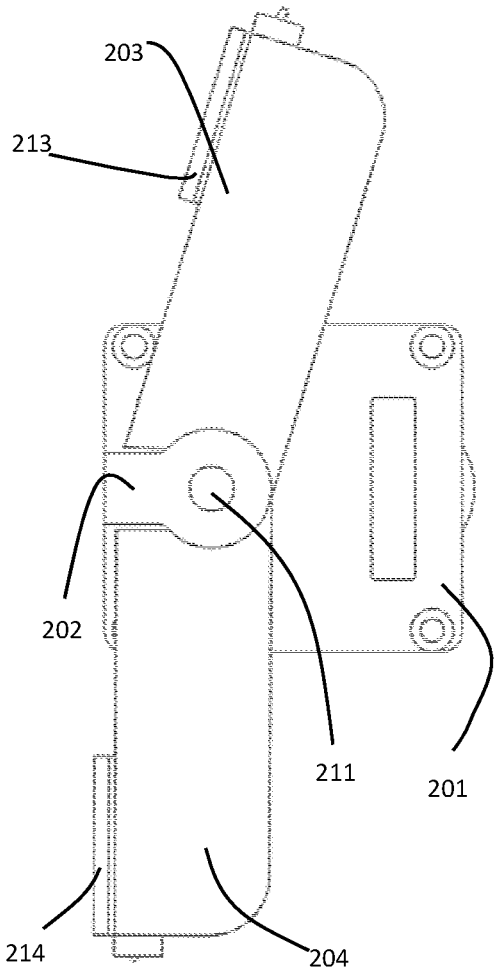
FIG. 2A is a front view of an example embodiment of a portable actuator device of the present disclosure.
Figure 2B:
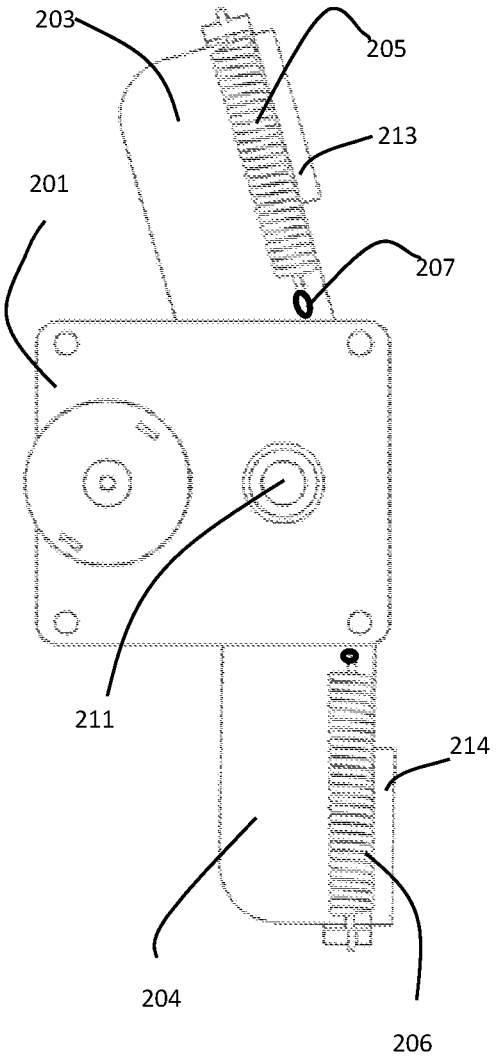
FIG. 2B is a rear view of the portable actuator device of FIG. 2A.

FIGS. 2A and 2B are a simplified depiction of the primary mechanism of the portable actuator device 200 (perspective view in FIG. 6), with the actuating arms 203 and 204 in the neutral, or parked position. FIG. 2A depicts the front side of the actuating arms 203 and 204, which engage the disconnect handle 102 shown in FIG. 1A. FIG. 2B depicts the back side of the actuating arms 203 and 204 and shows the top actuating arm return spring 205 and bottom actuating arm return spring 206, which are connected by the return spring connecting cable 207. The tension of the return springs 205 and 206 produce a force which tends to cause the actuating arms 203 and 204 to seek to return to the neutral position, as shown. In an alternative embodiment, the actuating arm return springs 205 and 206 may each be replaced with a different type as well as number of springs.

Figure 3A:
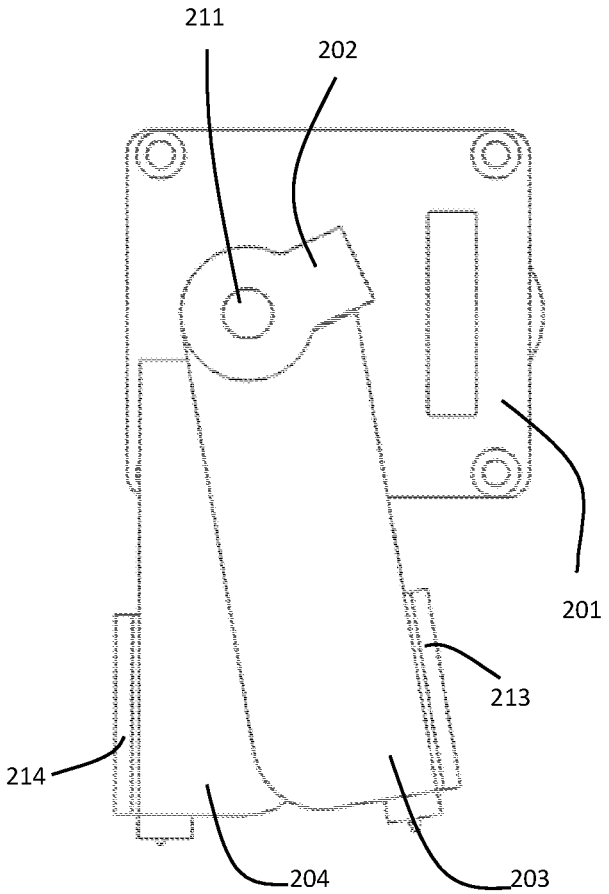
FIG. 3A is a front view of the portable actuator device of FIG. 2 with a top actuating arm in the (actuated) down position, i.e., the disconnect handle is moved to the open position (from a closed or tripped position).
Figure 3B:
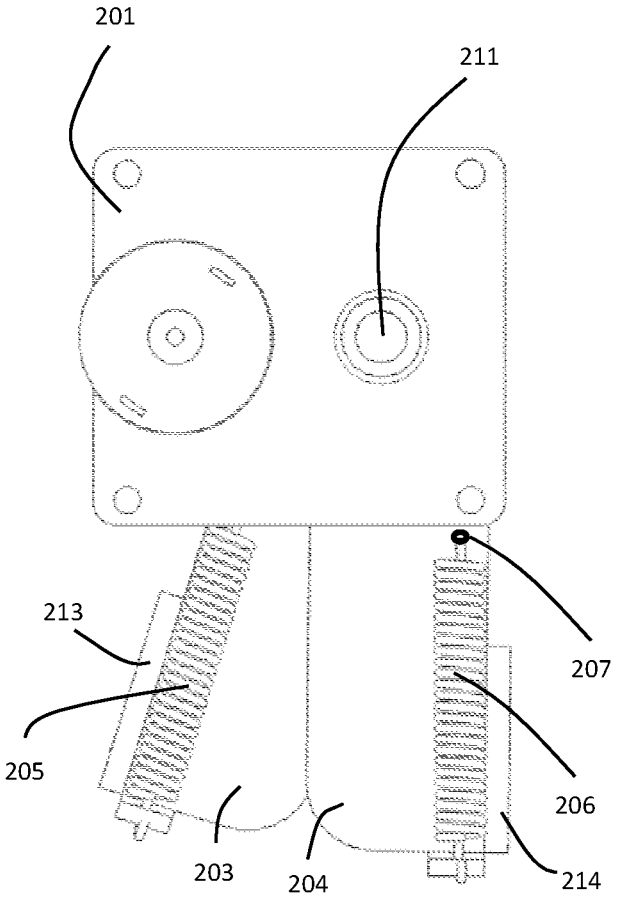
FIG. 3B is a rear view of the portable actuator device of FIG. 2 with the top actuating arm of FIG. 3A in the (actuated) down position, i.e., the disconnect handle is moved to the open position.

FIGS. 3A and 3B are a simplified depiction of the primary mechanism of the portable actuator device 200 In this position, the gearmotor 201 has been caused to rotate in a clockwise rotational direction as viewed from the shaft end, as viewed in FIG. 3A. A projection that extends from the drive cam 202 comes into contact with the top actuating arm 203 at a notch 223, causing the arm 203 to rotate about the axis of the gearmotor shaft 211. A generally rectangular finger 213 at the distal end of the top actuating arm 203 engages the breaker disconnect handle 102, shown in FIG. 1A, causing the disconnect handle 102 to move downward to the open position. FIG. 3B depicts the back side of the actuating arms 203 and 204 and shows the top actuating arm return spring 205 and bottom actuating arm return spring 206, which are connected by the return spring connecting cable 207. The tension of the return springs 205 and 206 produce a force which tends to cause the actuating arms 203 and 204 to seek to return to the neutral position, as shown in FIG. 2A.

Figure 4A:
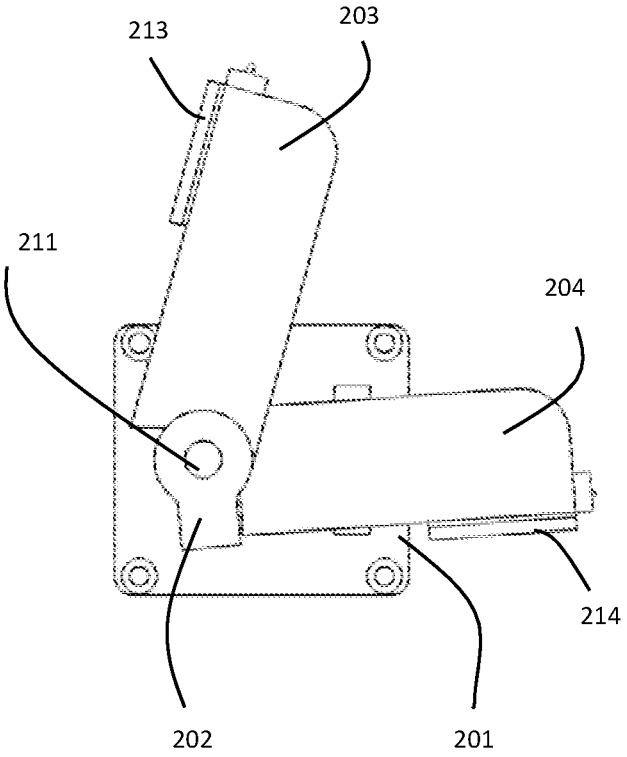
FIG. 4A is a front view of the portable actuator device of FIGS. 2 and 3 with a bottom actuating arm in the (actuated) up position, i.e., the disconnect handle is moved to the closed position (from an open or tripped position).
Figure 4B:
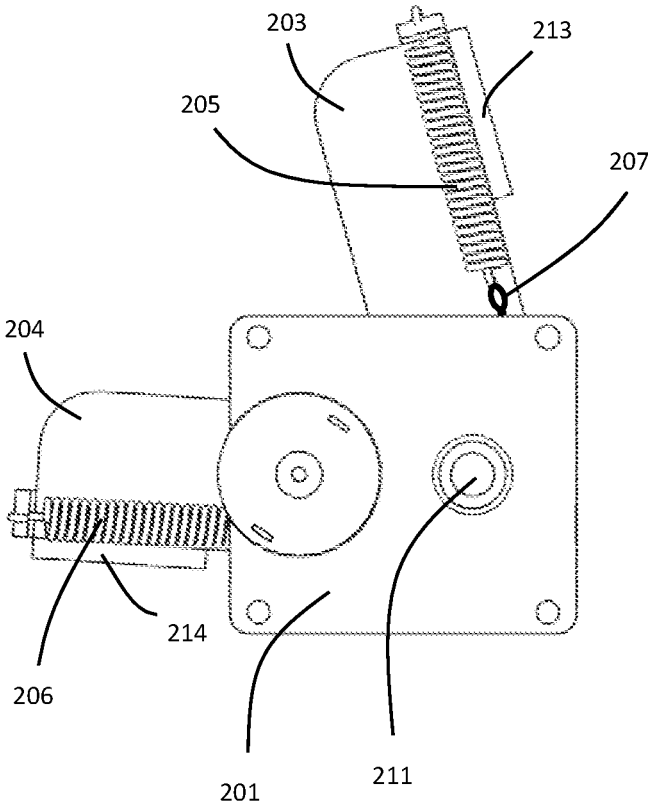
FIG. 4B is rear view of the portable actuator device of FIGS. 2 and 3 with the top actuating arm of FIG. 4A in the (actuated) down position, i.e., the disconnect handle is moved to the closed position.

FIGS. 4A and 4B are a simplified depiction of the primary mechanism of the portable actuator device 200 with the bottom actuating arm 204 in the up, or closed, position. FIG. 4A depicts the front side of the bottom actuating arm 204, which engage the disconnect handle shown in FIG. 1A 102. The projection that extends from the drive cam 202 comes into contact with the bottom actuating arm 204 at a notch 224, causing the arm 204 to rotate about the axis of the gearmotor shaft 211. A generally rectangular finger 214 at the distal end of the bottom actuating arm 204 engages the breaker disconnect handle 102, shown in FIG. 1A, causing the disconnect handle 102 to move upward to the closed position. FIG. 4B depicts the back side of the actuating arms 203 and 204 and shows the top actuating arm return spring 205 and bottom actuating arm return spring 206, which are connected by the return spring connecting cable 207. The tension of the return springs 205 and 206 produce a force which tends to cause the actuating arms 203 and 204 to seek to return to the neutral position, as shown in FIG. 2A.

Figure 5:
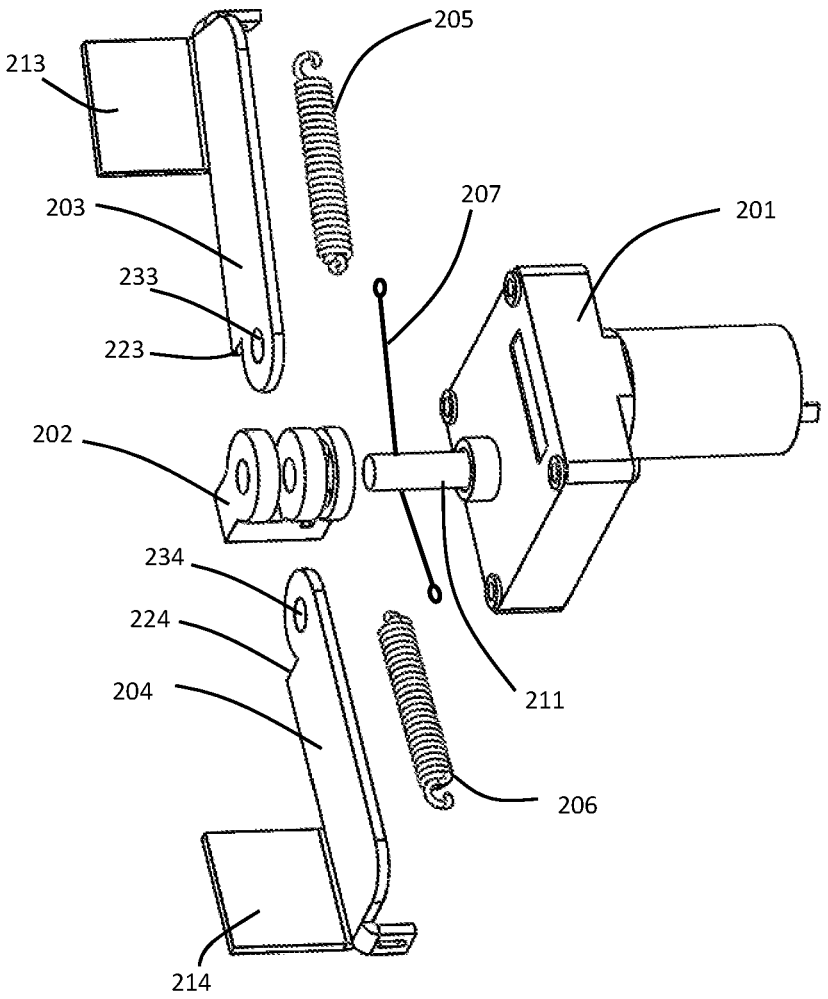
FIG. 5 is an exploded assembly view of the portable actuator device of FIGS. 2-4.

The primary mechanism of the portable actuator device 200 is shown in exploded assembly form in FIG. 5. The actuator arms 203 and 204 are each generally flat planar members, each having a distal end near their respective fingers 213 and 214 and a proximal end near the gearmotor shaft 211. Each of the actuator arms 203 and 204 has a respective circular aperture 233 and 234 near their respective proximal ends through which the drive shaft 211 passes. The actuator arms 203 and 204 reside adjacent to each other along the shaft 211 in the front slot of the drive cam 202. The gearmotor shaft 211 passes through the drive cam 202 and actuator arms 203 and 204. The drive cam 202 is rigidly affixed to a motor 211, which is preferably a gearmotor shaft 211. The gearmotor 211 is a combination of an electric motor and gears or a gear box. The motor associated with the gearmotor 101 can be an alternating current (AC) motor, brushed direct current (DC) motor, or brushless DC motor. The actuator arms 203 and 204 rotate freely on the gearmotor shaft 211. One end of the top return spring 205 is connected to the top actuating arm 203. The other end of the top return spring 205 is connected to the return spring connecting cable 207. The opposite end of the return spring connecting cable 207 is connected to the bottom return spring 206, with the opposite end of the bottom return spring 206 being connected to the bottom actuating arm 204. The force that is applied to the actuating arms 203 and 204 by the return springs 205 and 206 tends to cause the actuating arms 203 and 204 to rotate in opposite directions.

Figure 6:
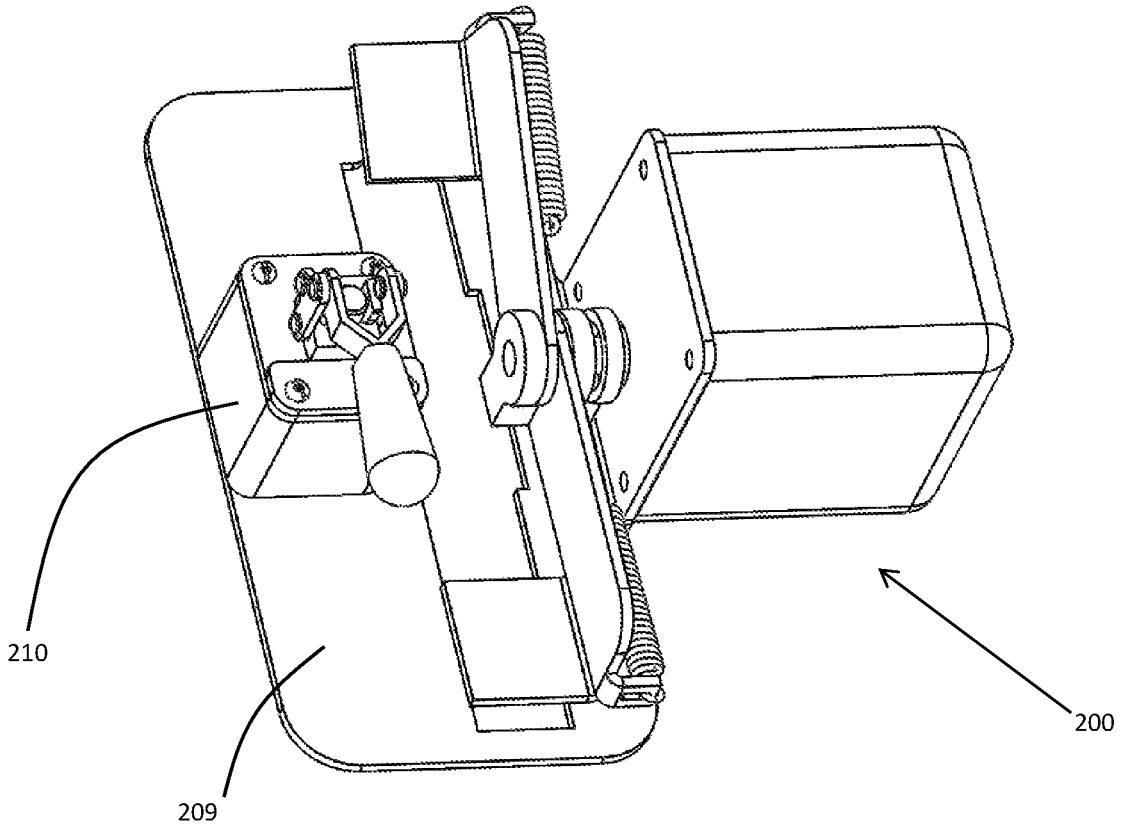
FIG. 6 is a perspective view of the portable actuator device of FIG. 2-5 with a frame and holding magnet assembly.

A completely assembled portable actuator device 200 is shown in perspective in FIG. 6. The portable actuator device 200 is depicted in the non-actuated, or neutral, position. A generally planar actuator frame 209 supports the gearmotor 201 and has a holding magnet assembly 210, which temporarily mounts the portable actuator device 200 to the MCC disconnect switch 100. The opening, or aperture, in the generally planar actuator frame 209 is sized to approximate the size of the base 101 of the disconnect handle 101 as shown in FIG. 1.

Figure 7:
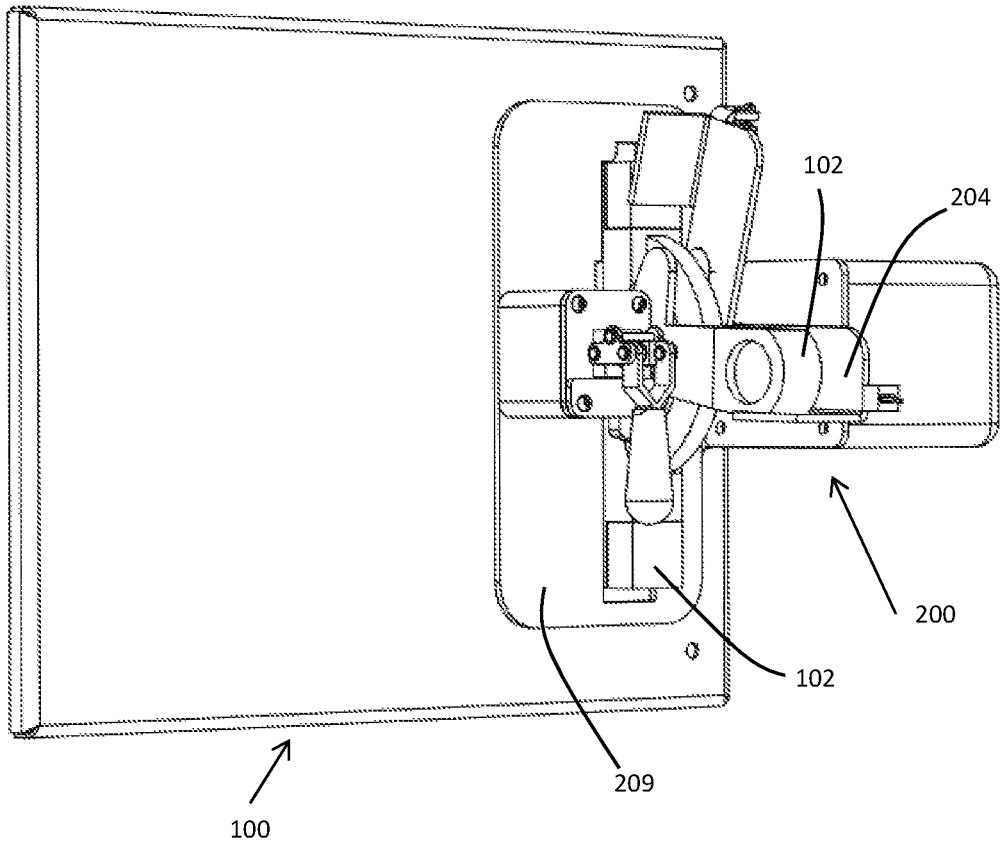
FIG. 7 is a perspective view of the portable actuator device of FIG. 6 mounted on an MCC disconnect switch, with the position of both, the portable actuator device and disconnect handle in the closed position.

FIG. 7 depicts the portable actuator device 200 mounted on and to the MCC disconnect switch 100. The actuator frame 209 has an opening that approximates the size and shape of the base 101 of the disconnect handle 101, as shown in FIG. 1, which provides for proper alignment of portable actuator device 200 and the disconnect handle 102. In this depiction, the bottom actuating arm 204 has rotated in a counter-clockwise rotational direction as viewed from the shaft end. The bottom actuating arm 204 comes into contact with the disconnect handle 102, moving it up to the closed position, as shown.

Figure 8:
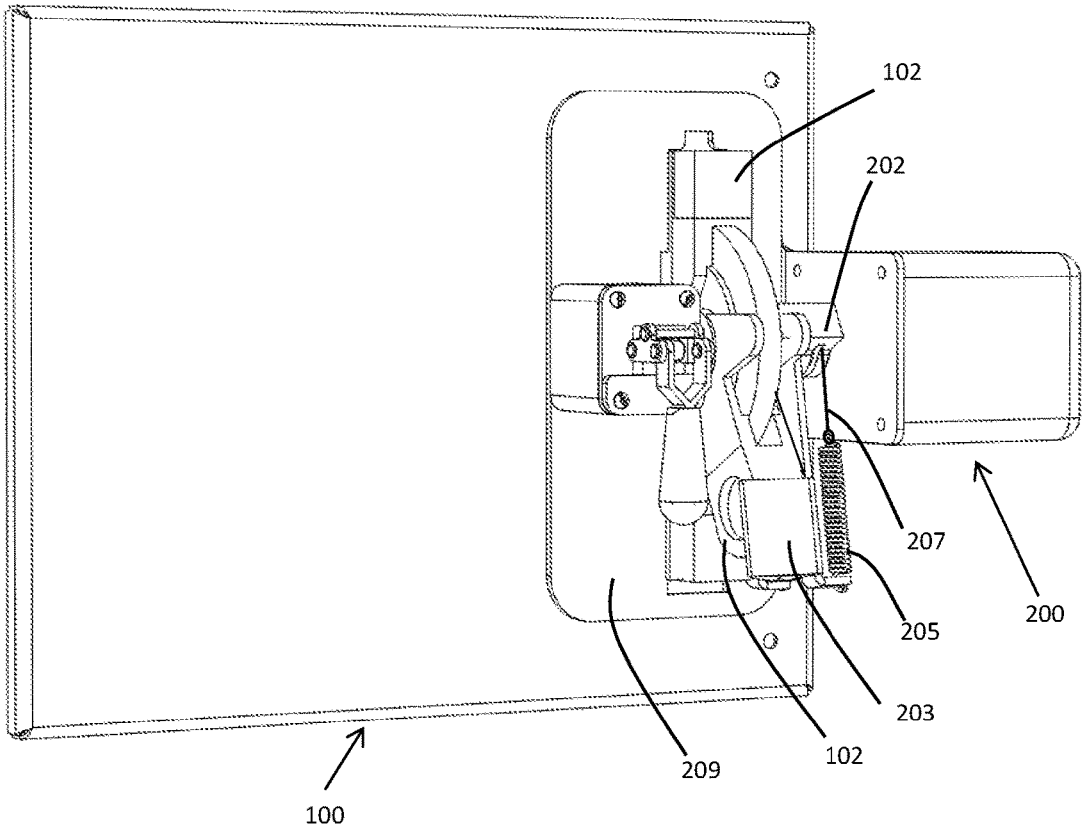
FIG. 8 is a perspective view of the portable actuator device of FIGS. 6 and 7 mounted on an MCC disconnect switch, with the position of both, the portable actuator device and disconnect handle in the open position.

FIG. 8 depicts the portable actuator device 200 mounted on the MCC disconnect switch 100. In this depiction, the top actuating arm 203 has rotated in a clockwise rotational direction as viewed from the shaft end. The top actuating arm 203 comes into contact with the disconnect handle 102, moving it down to the open position, as shown.

Figure 9:
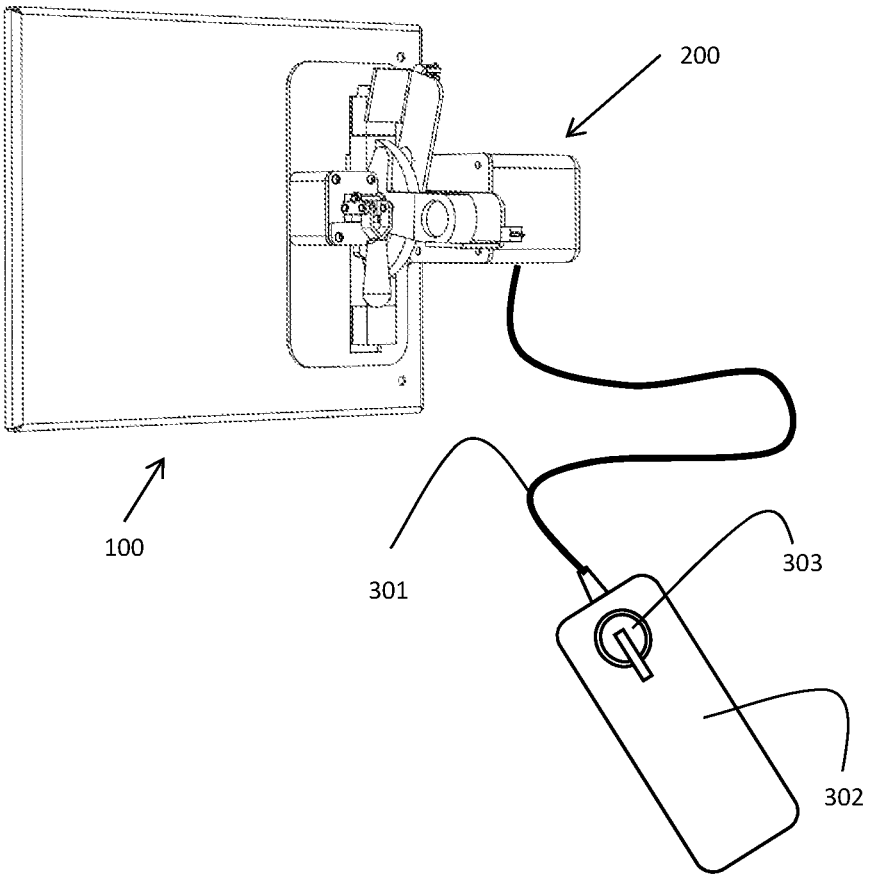
FIG. 9 depicts a portable actuator system for remotely operating an electrical disconnect switch with the portable actuator device of FIGS. 6-8.

FIG. 9 depicts a portable actuator system 300 for remotely operating electrical disconnect switches with the portable actuator device 200. When a remote actuator device 200 is affixed to a disconnect switch 100, a control cable 301 connects the portable actuator device 200 to an operator interface 302, for example, a handheld control station 302, thus allowing the portable actuator device 200 to be remotely operated by the operator from a safe distance. In an alternative embodiment, the handheld control station 302 could be communicatively coupled to the remote actuator device 200 via a suitable wireless interface. In this embodiment, the handheld control station 302 has a rotary dial switch 303 that controls the gearmotor 201. The dial switch 303 is shown in an off position in FIG. 9. When the dial switch is rotated counterclockwise, the gearmotor 201 is commanded to rotate its shaft 211 counterclockwise as viewed from the shaft end. Conversely, when the dial switch 303 is rotated clockwise, the gearmotor 201 is commanded to rotate its shaft 211 clockwise from the perspective of the shaft end. Other types of operator interfaces are possible, such as those with a display screen, other types of controls, inputs, and outputs, etc.

Figure 10:
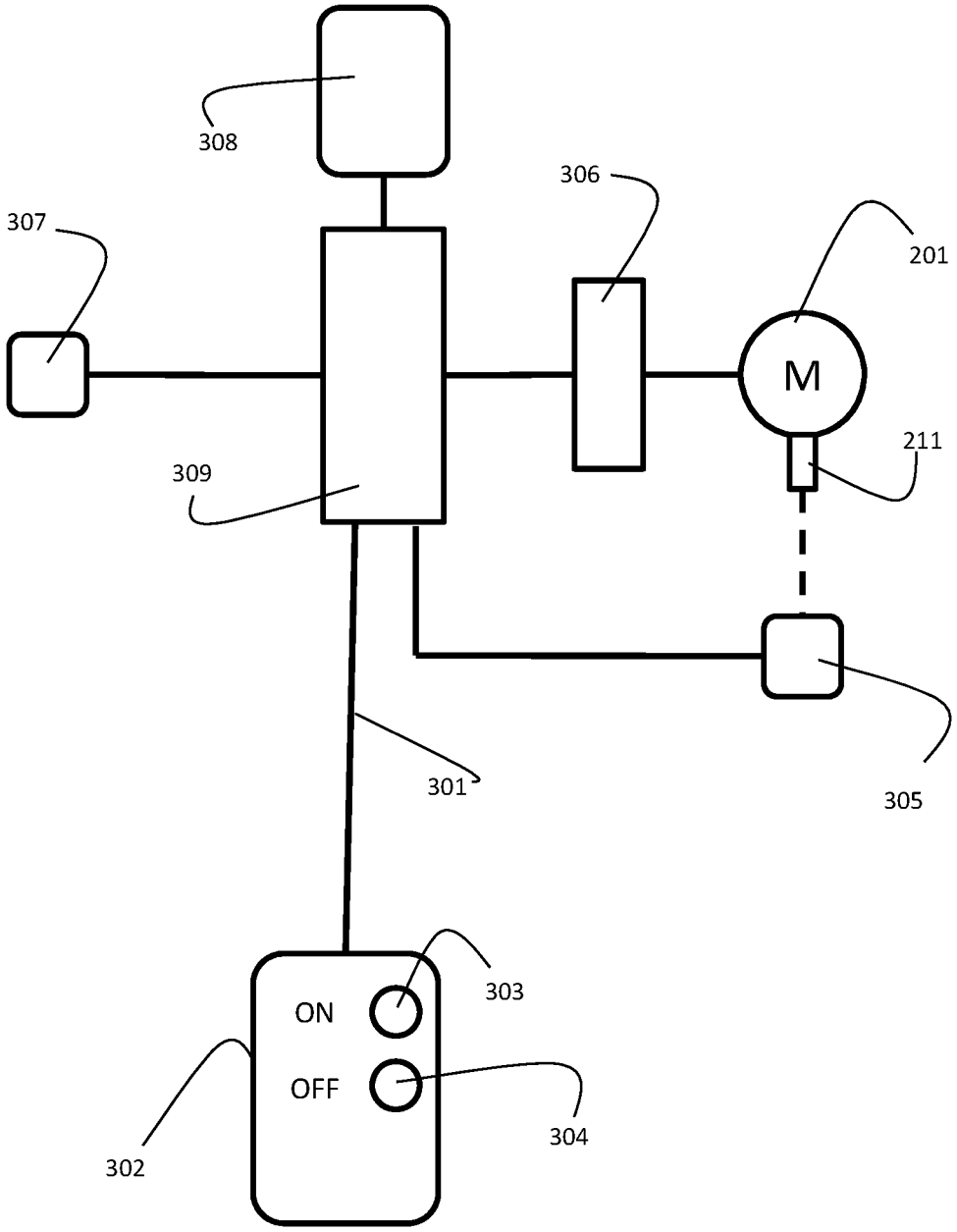
FIG. 10 is a functional block diagram showing an embodiment of the electrical architecture of the portable actuator system of FIG. 9, which has a wired electrical connection between an operator interface and the portable actuator device.

FIG. 10 is a functional block diagram showing an embodiment of the electrical architecture of the portable actuator system of FIG. 9, which has a wired electrical connection 301 between the operator interface 302 and the portable actuator device. In this example, the operator interface 302 has an on switch 303 and off switch 304 for moving the disconnect switch to the on and off positions, respectively. The portable actuator system 300 has a computer-based controller 309 on a circuit board with a processor for executing a set of programmable instructions stored in a nonvolatile storage medium, also situated on the circuit board. The circuit board and its power supply 308 are situated within the housing associated with the gearmotor 201, in this embodiment. The controller 309 controls a motor driver 306, which drives the gearmotor 201 and drive shaft 211.

Figure 11:
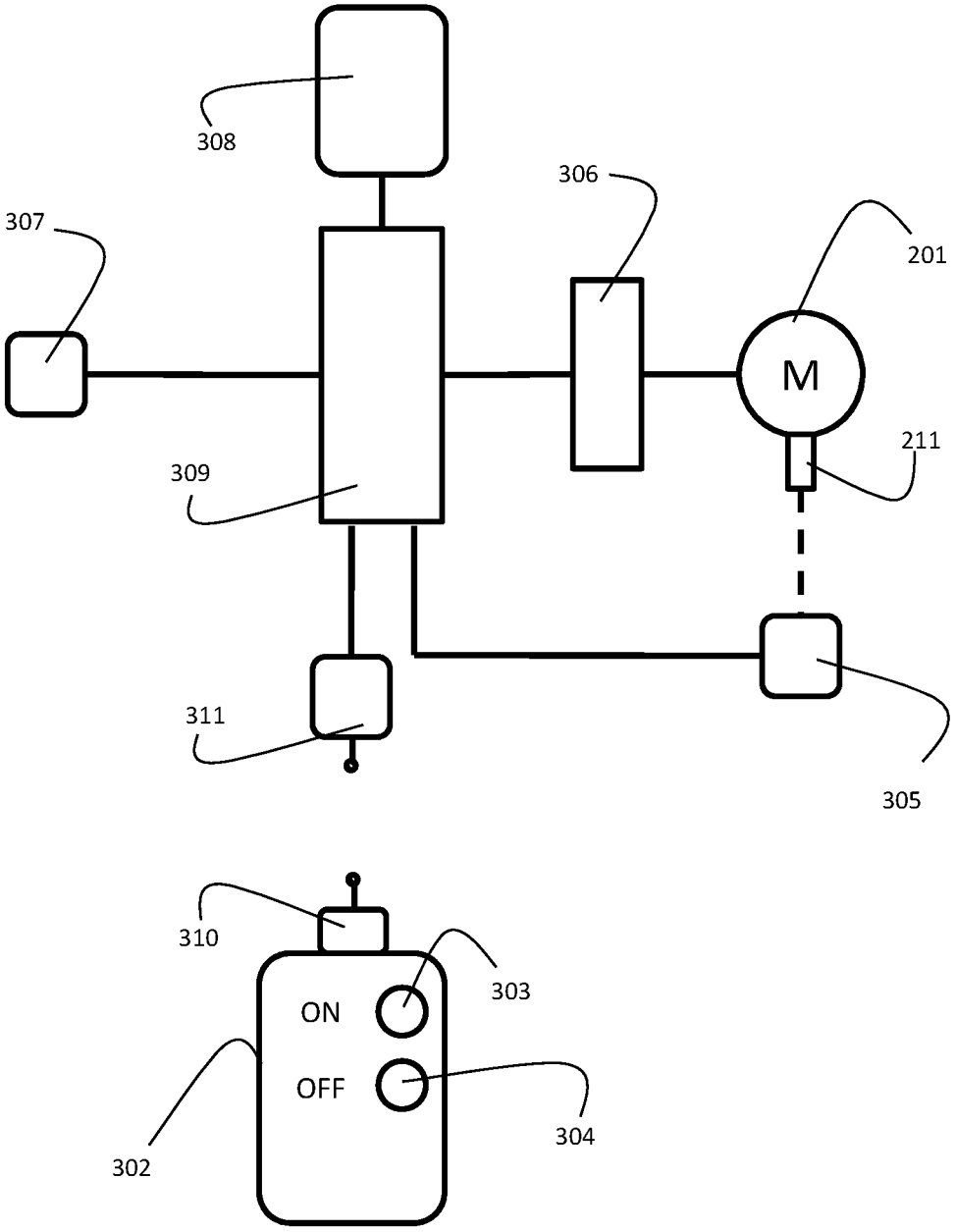
FIG. 11 is a functional block diagram showing an alternative embodiment of the electrical architecture of the portable actuator system of FIG. 9, which has a wireless electrical connection between an operator interface and the portable actuator device.

FIG. 11 is a functional block diagram showing an embodiment of the electrical architecture of the portable actuator system of FIG. 9, which has a wireless electrical connection 301 between the operator interface 302 and the portable actuator device. In this example, the architecture includes a wireless transmitter 310 associated with the operator interface 302 that is communicatively coupled with a wireless receiver 311 that is connected with the controller 309 to enable the operator interface 302 to communicate commands to the controller 309.

The gearmotor 201 can also include an internal shaft position sensor 305 (for example, a potentiometer) that communicates signals to the controller 309 that are indicative of the rotational position of the gearmotor shaft 211, so that the controller 309 can track movement of the gearmotor shaft 211. Thus, the controller can sense when the actuator arms 203 and 204 are in the open position, closed position, or neutral position. So, in operation, the actuating arms 203 and 204 start in the neutral position (FIGS. 2A and 2B). Then, if the controller 309 controls the gearmotor 201 to rotate its shaft 211 to move the top actuating arm 203 to the open position (FIGS. 3A and 3B), the controller then controls the gearmotor 201 to rotate its shaft 211 so that the actuating arm 203 is returned to the neutral position (FIGS. 2A and 2B). If the controller 309 controls the gearmotor 201 to rotate its shaft 211 to move the bottom actuating arm 204 to the closed position (FIGS. 4A and 4B), the controller then controls the gearmotor 201 to rotate its shaft 211 so that the bottom actuating arm 204 is returned to the neutral position (FIGS. 2A and 2B).

In an alternative embodiment, the gearmotor 201, controller, or frame 209 can be equipped with a sensor 307, for example, an accelerometer, gyroscope, etc., that detects an orientation and communicates this information to the controller 309. With this information, the controller 309 can make adjustments to the operator interface 302. For instance, the operator interface 302 may have indicators, such as up and down, right and left, or open and close. With this orientation information, the controller 309 can ensure that these indicators are in fact the way the disconnect handle will be controlled.

It should be emphasized that the above-described embodiments of the present invention are merely a possible non-limiting examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention.

For example, note that for reasons of simplicity and clarity, the description of the disclosed invention assumes it is applied to a vertically operated switch. However, the disclosed device is equally suitable for use with a disconnect handle that operates in a horizontal orientation. Such a device would be an alternative embodiment to that described above.

In another alternative embodiment, the gearmotor 201, controller, or frame 209 can be equipped with a sensor, for example, an accelerometer, gyroscope, etc., that detects an orientation and communicates this information to the controller. With this information, program code associated with the controller can make adjustments to the operator interface. For instance, the operator interface may have indicators, such as up and down, right and left, or open and close. With this orientation information, the controller can ensure that these indicators are in fact the way the disconnect handle will be controlled.

In another alternative embodiment, the holding magnet assembly 210 can be replaced with one or more suction cups in order to mount the frame 209 of the portable actuator device 200 to the disconnect switch 100.

In another alternative embodiment, the holding magnet assembly can be replaced by mounting the frame 209 of the portable actuator device 200 to the disconnect switch 100 by attaching it to a feature, for example, a bolt, opening, hole, bracket, stud, or edge, associated with the disconnect switch 100 with, for example, a clamp, bolt. etc.

At least the following is claimed:

1. A portable actuator system for enabling remote actuation of a disconnect switch, the disconnect switch having a disconnect handle that is movable to at least an open position and a closed position, the disconnect handle extending outwardly from the disconnect switch and having a distal end that is rotationally moved when the disconnect handle is moved between the open and closed positions, the system comprising:

an electric motor having a drive shaft that can be controlled to rotate about a longitudinal axis;

an elongated first arm having a first arm distal end and a first arm proximal end;

an elongated second arm having a second arm distal end and a second arm proximal end;

wherein the first arm is capable of pivoting at the first arm proximal end about the axis while the second arm remains in a non-actuated position in close proximity to the frame when the drive shaft is rotated in a first rotational direction so that first arm distal end is moved about the axis in the first rotational direction, the first arm for engaging and moving the disconnect handle in the first rotational direction so that the disconnect handle is switched to the open position;

wherein the second arm is capable of pivoting at the second arm proximal end about the axis while the first arm remains in a non-actuated position in close proximity to the frame when the drive shaft is rotated in a second rotational direction so that the second arm distal end is moved about the axis in the second rotational direction, the second rotational direction being opposite to the first rotational direction, the second arm for engaging and moving the disconnect handle in the second rotational direction so that the disconnect handle is switched to the closed position;

a controller communicatively coupled to the electric motor to control the electric motor and the arms; and an operator interface communicatively coupled to the controller, the operator interface designed to enable an operator to remotely control the electric motor and the arms in order to selectively engage and move the disconnect handle to the open and closed positions.

2. The system of claim 1, further comprising:

a generally planar frame to which is mounted the motor and arms, the frame having an aperture through which the disconnect handle is received; and first and second fingers extending outwardly and perpendicularly from the elongated first and second arms, respectively, the first and second fingers designed to extend over the aperture and behind the distal end of the disconnect handle, the first finger for engaging the disconnect handle when the first arm is moved in the first rotational direction, the second finger for engaging the disconnect handle when the second arm is moved in the second rotational direction.

3. The system of claim 2, further comprising a holding magnet assembly for temporarily mounting the frame to a surface of the disconnect switch.

4. The system of claim 2, further comprising a spiral-wound elongation spring associated with each of the first and second arms to provide a force that causes each of the arms to seek to return to the non-actuated position, the non-actuated position being one where the distal ends of the arms are in close proximity to the frame.

5. The system of claim 2, further comprising a suction cup that enables temporary mounting of the frame to a surface of the disconnect switch.

6. The system of claim 2, further comprising a means for attaching the frame to a permanent feature of the disconnect switch.

7. The system of claim 2, further comprising:

a sensor that detects an orientation of the frame; and program code associated with the controller that is designed to adjust the operator interface based at least in part upon a detected orientation.

8. The system of claim 7, wherein the sensor is an accelerometer or gyroscope.

9. The system of claim 2, wherein the first and second arms are each generally flat planar members, each having a circular aperture near the respective first and second proximal ends through which the drive shaft passes, and each comprising respective first and second notches situated near the respective first and second proximal ends, and further comprising a drive cam attached to and rotatable by the drive shaft, the drive cam having a projection extending outwardly in a radial direction from the drive shaft, the projection designed to engage the first arm in the first notch when the first arm engages and moves the disconnect handle, the projection designed to engage the second arm in the second notch when the second arm engages and moves the disconnect handle.

10. The system of claim 9, wherein the first and second fingers are generally planar rectangular extensions that are generally at a right angle relative to the respective first and second arms.

11. A portable actuator system for enabling remote actuation of a disconnect switch, the disconnect switch having a disconnect handle that is movable to at least an open position and a closed position, the disconnect handle extending outwardly from the disconnect switch and having a distal end that is rotationally moved when the disconnect handle is moved between the open and closed positions, the system comprising:

rotation means for engaging and rotating the disconnect handle associated with the disconnect switch;

driving means for driving the rotation means;

attachment means for attaching the rotation means and the electric motor means to the disconnect switch so that the electric motor means remains stationary while the rotation means moves, engages, and rotates the disconnect handle; and controller means for enabling an operator to control the electric motor means to move the disconnect handle to the open and closed positions;

wherein the rotation means comprises:

an elongated first arm having a distal end and a proximal end, the first arm capable of pivoting at the proximal end about a longitudinal axis when the drive shaft is rotated in a first rotational direction so that the distal end is moved about the axis in the first rotational direction, the first arm for engaging and moving the disconnect handle in the first rotational direction so that the disconnect handle is switched to the open position;

an elongated second arm having a distal end and a proximal end, the second arm capable of pivoting at the proximal end about the axis when the drive shaft is rotated in a second rotational direction so that the distal end is moved about the axis in the second rotational direction, the second rotational direction being opposite to the first rotational direction, the second arm for engaging and moving the disconnect handle in the second rotational direction so that the disconnect handle is switched to the closed position; and wherein the first and second arms are each generally flat planar members, each having a circular aperture near respective first and second proximal ends through which the drive shaft passes, and each comprising respective first and second notches situated near the respective first and second proximal ends, and further comprising a drive cam attached to and rotatable by the drive shaft, the drive cam having a projection extending outwardly in a radial direction from the drive shaft, the projection designed to engage the first arm in the first notch when the first arm engages and moves the disconnect handle, the projection designed to engage the second arm in the second notch when the second arm engages and moves the disconnect handle.

12. The system of claim 11, wherein the driving means further comprises an electric motor having a drive shaft that can be controlled to rotate about a longitudinal axis.

13. The system of claim 11, wherein the controller means further comprises:

a controller communicatively coupled to the driving means to control the electric motor means; and an operator interface communicatively coupled to the controller, the operator interface designed to enable an operator to remotely control the driving means in order to selectively engage and move the disconnect handle to the open and closed positions.

14. The system of claim 11, wherein the attachment means further comprises a magnet.

15. The system of claim 11, wherein the attachment means further comprises a suction cup.

16. A portable actuator device for enabling remote actuation of a disconnect switch, the disconnect switch having a disconnect handle that is movable to at least an open position and a closed position, the disconnect handle extending outwardly from the disconnect switch and having a distal end that is rotationally moved when the disconnect handle is moved between the open and closed positions, the device comprising:

an electric motor having a drive shaft that can be controlled to rotate about a longitudinal axis;

an elongated first arm having a distal end and a proximal end, the first arm capable of pivoting at the proximal end about the axis when the drive shaft is rotated in a first rotational direction so that the distal end is moved about the axis in the first rotational direction, the first arm for engaging and moving the disconnect handle in the first rotational direction so that the disconnect handle is switched to the open position;

an elongated second arm having a distal end and a proximal end, the second arm capable of pivoting at the proximal end about the axis when the drive shaft is rotated in a second rotational direction so that the distal end is moved about the axis in the second rotational direction, the second rotational direction being opposite to the first rotational direction, the second arm for engaging and moving the disconnect handle in the second rotational direction so that the disconnect handle is switched to the closed position;

the first and second arms are each generally flat planar members, each having a circular aperture near the respective first and second proximal ends through which the drive shaft passes, and each comprising respective first and second notches situated near the respective first and second proximal ends, and further comprising a drive cam attached to and rotatable by the drive shaft, the drive cam having a projection extending outwardly in a radial direction from the drive shaft, the projection designed to engage the first arm in the first notch when the first arm engages and moves the disconnect handle, the projection designed to engage the second arm in the second notch when the second arm engages and moves the disconnect handle;

a generally planar frame to which is mounted the motor and arms, the frame having an aperture through which the disconnect handle is received;

first and second fingers extending outwardly and perpendicularly from the elongated first and second arms, respectively, the first and second fingers designed to extend over the aperture and behind the distal end of the disconnect handle, the first finger for engaging the disconnect handle when the first arm is moved in the first rotational direction, the second finger for engaging the disconnect handle when the second arm is moved in the second rotational direction; and means for attaching the frame to the disconnect switch.

17. The device of claim 16, wherein the first and second fingers are generally planar rectangular extensions that are generally at a right angle relative to the respective first and second arms.

18. The device of claim 16, further comprising:

a controller communicatively coupled to the electric motor to control the electric motor and the arms; and an operator interface communicatively coupled to the controller, the operator interface designed to enable an operator to remotely control the electric motor and the arms in order to selectively engage and move the disconnect handle to the open and closed positions.

19. The device of claim 18, further comprising:

a sensor that detects an orientation of the frame; and program code associated with the controller that is designed to adjust the operator interface based at least in part upon a detected orientation.

* * * * *